United States Patent [19]

Suzuki

[11] Patent Number: 4,809,144

[45] Date of Patent: Feb. 28, 1989

[54] VEHICLE HEADLAMP WITH A VENT HOLE

[75] Inventor: Tooru Suzuki, Tokyo, Japan

[73] Assignee: Stanley Electric Co., Ltd., Tokyo, Japan

[21] Appl. No.: 127,807

[22] Filed: Dec. 2, 1987

[30] Foreign Application Priority Data

Dec. 11, 1986 [JP] Japan ..... 61-191047[U]
Mar. 31, 1987 [JP] Japan ..... 62-48822[U]

[51] Int. Cl.[4] ..... F21V 29/00

[52] U.S. Cl. ..... 362/294; 362/80; 362/345

[58] Field of Search ..... 362/61, 80, 294, 345, 362/373

[56] References Cited

U.S. PATENT DOCUMENTS 4,612,607 9/1986 Segoshi et al. ..... 362/345 X

*Primary Examiner*—Stephen F. Husar
*Attorney, Agent, or Firm*—Frishauf, Holtz, Goodman & Woodward

[57] ABSTRACT

A vehicle headlamp in which an elongated tubular container having small openings in front and rear ends thereof and filled therein with a drying agent extends through the lamp housing. The size of the small opening at the end of the container which is interior of the lamp housing is smaller than the size of the small opening in the end of the container which is exterior of the lamp housing.

20 Claims, 4 Drawing Sheets

PRIOR ART FIG. 6

PRIOR ART FIG. 7

PRIOR ART FIG. 8

VEHICLE HEADLAMP WITH A VENT HOLE

BACKGROUND OF THE INVENTION (1) Field of the Invention

The present invention relates to a vehicle headlamp having a vent hole.

(2) Description of the Prior Art

A prior art vehicle headlamp having a vent hole is basically constructed such as shown in FIG. 6. A drying agent 22 such as silica gel is filled in a container 21 having small holes 21*a* and 21*b* in opposite ends thereof, the container 21 extending through the housing (reflector) 23. Reference numeral 24 designates a lens of the prior art headlamp.

In the vehicle headlamp provided with the vent hole constructed as described above, a pressure rise in the headlamp is suppressed by the vent hole. Further, air coming from the outside is dehumidified by the drying agent 22.

The drying agent 22, which is in the state of moisture absorption by the dehumidification of air coming from the outside, is dried by heat generated when the lamp is lit, to thereby release water content thereof. That is, a recycle effect is provided.

To minimize the contact with open air, a porous resin film 25 having a permeability is disposed on the end of the housing 23 which is external of the container 21 as shown in FIG. 7, or means such as a mechanical valve 26 as shown in FIG. 8 is provided on the external end of container 21.

However, where the recycle effect is provided for the drying agent 22 as described above, it can be expected that the water content released from the drying agent 22 due to the temperature rise when the lamp is lit is discharged to the outside of the lamp due to the internal pressure of the headlamp. But, since a flow of air flowing out of the headlamp stops after a lapse of a fixed time, if the moisture absorption of the drying agent 22 is large, the release of water content continuously takes place thereafter, and the water content also flows into the headlamp through the small hole 21*a* in the end of the container 21 which is inside the housing 23.

At this time, the interior of the container 21 is in the state of high temperature and high humidity, and the air of the high temperature and high humidity flows into the housing 23 without the air of the high temperature and high humidity being humidity-absorbed into the drying agent 22, by the air flowing therein as the lamp is deenergized.

On the other hand, where the porous resin film 25 (FIG. 7) or the valve 26 (FIG. 8) is provided in order to cut off the open air, the discharge of the releasing water content to the outside of the lamp during the above-mentioned venting course is not only impaired by the film 25 or the valve 26 but also conversely the flow of water content into the inside of the lamp is accelerated. Moreover, the mechanical valve construction (of FIG. 8) must function to control the flow of air passing through the vent hole, as a consequence of which the construction becomes complicated and increased in size, leading to higher cost.

SUMMARY OF THE INVENTION

It is therefore an object of the present invention to provide a vehicle headlamp with a vent hole which is lower in cost and which can provide a sufficient dehumidification effect.

According to the present invention, there is provided a vehicle headlamp in which an elongated tubular container having small holes in front and rear ends thereof and filled therein with a drying agent is disposed to be extended through a reflector, characterized in that the size of the small hole in the inner end of the container is made smaller than that of the outer end thereof.

BRIEF DESCRIPTION OF THE DRAWINGS

FIGS. 6 to 8, respectively, are sectional views showing a conventional device.

DESCRIPTION OF THE PREFERRED EMBODIMENTS

Figure 1:
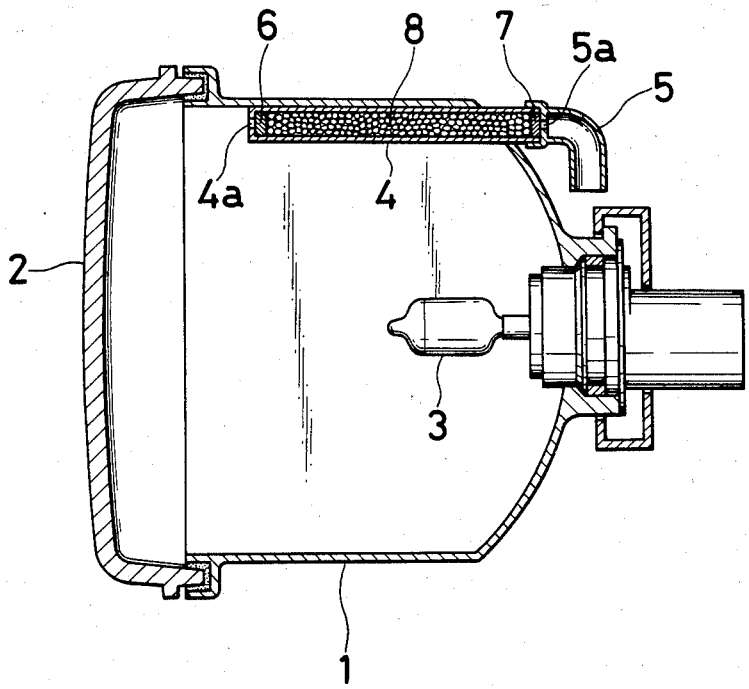
FIG. 1 is a sectional view showing one embodiment of a headlamp for a vehicle according to the present invention.

The present invention will be described in detail on the basis of the embodiments shown in the drawings.

Referring now to FIG. 1 showing one embodiment of the present invention, reference numeral 1 designates a reflector and a housing, 2*a* lens, 3 a bulb (electric bulb), and 4*a* container having a small hole 4*a* in one end thereof, the container extending through the housing 1 so that the small hole 4*a* is positioned internally of the housing 1. An L-shaped tube 5 is provided on the other open end of the container 4. This L-shaped tube 5 has a small hole 5*a* in the end joined with the container 4. On one end of the container 4 on the small hole 4*a* side is disposed a porous resin film 6 having a permeability, and on the other end is disposed a filter 7. The interior of the container 4 is filled with a drying agent 8 such as silica gel.

Figure 2:
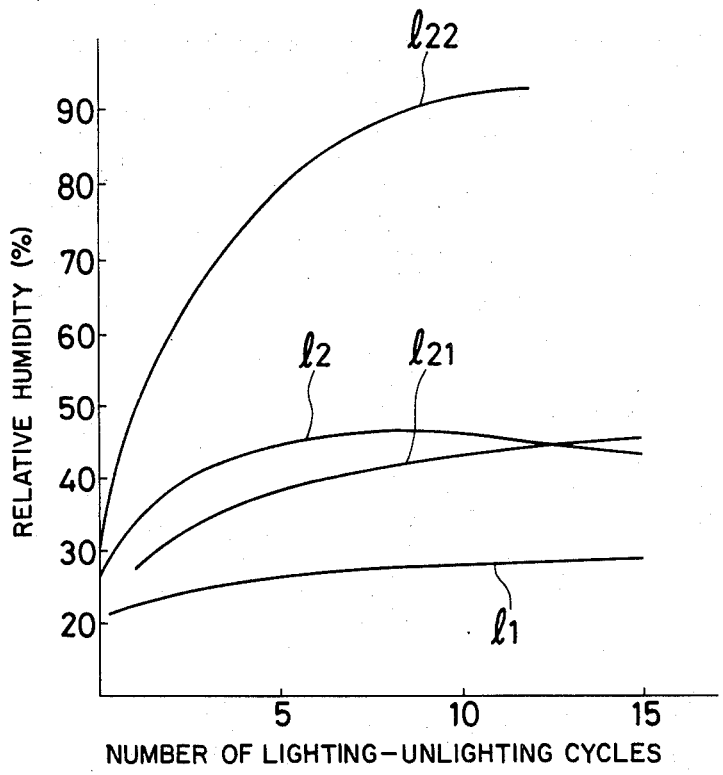
FIG. 2 is a characteristic curve showing the relation of the lighting and unlighting cycle and the humidity within the headlamp.

Preferably, the container 4 is mounted at a place where a change in temperature is rapidly produced when the lamp is lighted (turned on) and unlighted (turned off). This provision is made so as to respond to the moisture absorption of the drying agent, high humidity dependability of release of water content, change in outflow and inflow to the change in temperature quickly.

Where the headlamp provided with the vent hole constructed as described above and the headlamp provided with the vent hole according to the conventional construction are repeatedly lighted and unlighted, the change of humidity within the lamps is given in FIG. 2. In FIG. 2, curves l1 and l2 show the characteristic of the present embodiment whereas l21 and l22 show the characteristics of the prior art. The characteristic curves l2 and l22 are of the case in which the drying agent is in the state of moisture absorption.

In the case of the prior art, if the drying agent is well dried, the air of high temperature and high humidity flowing from outside is moisture-absorbed to some extent, whereas when the drying agent is in the state of moisture absorption, the drying agent acts to release water content without dehumidifying, and the headlamp becomes dim.

On the other hand, in the case of the present invention, sufficient dehumidifying effect is obtained not only when the drying agent 8 is dried, but also when it is absorbing moisture content. Moreover, the recycle effect clearly appears in the form of a reduction in humidity inside the lamp when the drying agent 8 is in the state of moisture absorption.

Figure 3:
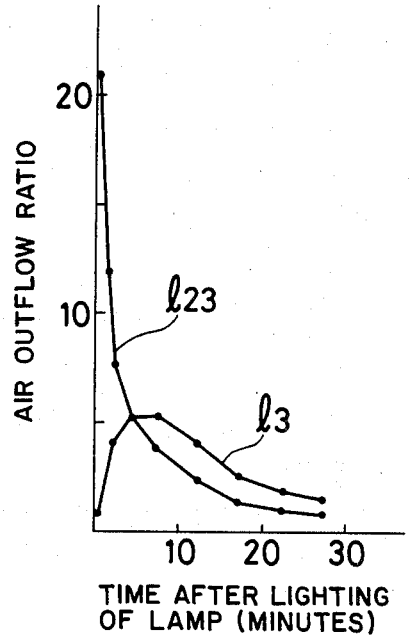
FIG. 3 is a characteristic curve showing the variation in time of the total outflow of the vent hole to the outflow per minute.

FIG. 3 shows the variation in time of the outflow of air flowing outside through the vent hole when the lamp is lit. In FIG. 3, curve l23 and curve l3 show the characteristic of the prior art and the present embodiment, respectively.

In the prior art, the outflow immediately after lighting is the maximum, and thereafter it rapidly reduces. The water content released from the drying agent which continues to rise in temperature no longer flows outside, but stays within the vent hole or flows into the housing via the small hole 21*a*. The variation in time of the inflow of air flowing into the interior via the vent hole when the lamp is unlighted (turned off) is exactly the same as the variation in time when the lamp is lit. Accordingly, a large quantity of air flows in within a short period of time. At this time, the drying agent still is in the state of high temperature at which the dehumidifying effect cannot be expected, and therefore the air flows into the housing without being dehumidified.

On the other hand, in the case of the present embodiment of the present invention, the variation in time of the outflow and inflow takes the form of a peak (curve l3 in FIG. 3) after a fixed time and thereafter gradually reduces. This results from the effect of the permeable porous resin film 6 positioned between the inner small hole 4a and the drying agent 8.

As a result, when the lamp is lit, the release of water content from the drying agent 8 starts and then the outflow of gas starts; as the release of water content increases, the outflow also increases; even after the outflow reaches a peak, the outflow is maintained over a long period of time; and the discharge of the released water to the outside of the lamp is maintained. On the other hand, when the lamp is unlighted, the inflow of the open air starts after the drying agent 8 starts to cool; the inflow is average; and the inflow time is long. Thereafore, a further effect is attained in removal of water content which stays within the vent hole immediately after unlighting and lowering of the water content in air flowing in from the outside.

Figure 4:
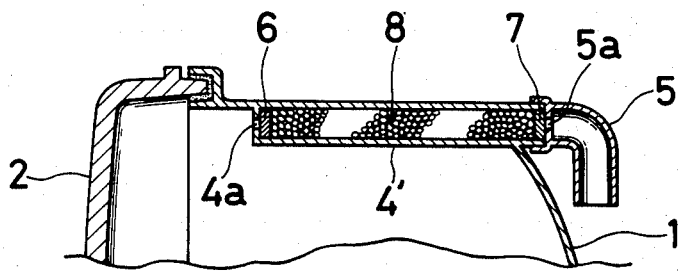
FIGS. 4 and 5, respectively, are sectional views showing another embodiment of the present invention.

In the above-described embodiment, the container 4 is separately formed, and this container is made to extend through the housing (reflector) and is retained in place. It is to be noted that a container portion 4' can be formed integral with the housing 1 as shown in FIG. 4. In addition, while the filter 7 disposed on the end of the container 4 is provided to prevent outflow of the drying agent 8 and inflow of dust or the like while maintaining a permeability, it is to be noted that the filter 7 can be made of a material similar to that of the permeable porous resin film 6 on the inner small hole 4*a* side, provided that it has a higher permeability than that of the resin film 6 on the inner side.

Figure 5:
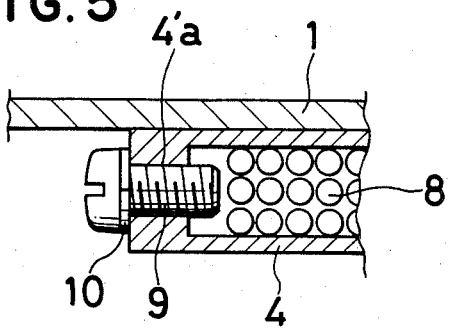
Figure 5:
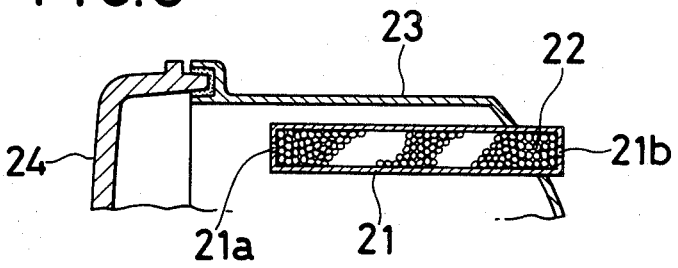
Figure 5:
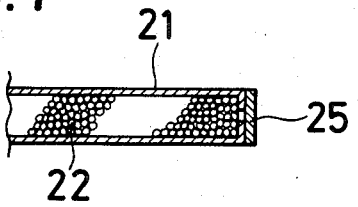
Figure 5:
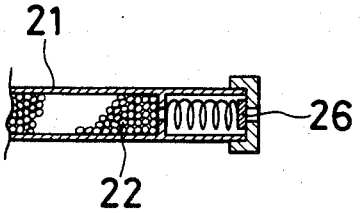

FIG. 5 shows another embodiment of the present invention, in which a small hole in the inner end of the container 4 is in the form of a threaded hole 4'*a*, and a screw 9 is screwed into the threaded hole 4'*a* in place of the permeable porous resin film 6 in the aforementioned embodiment. In this case, a spring washer 10 is provided.

With this arrangement, the interior of the lamp (interior of the reflector 1) and the interior of the container 4 are in communication with each other through a clearance between the threaded hole 4'*a* and the screw 9 and through an extremely elongated passage in the form of a slit of the spring washer 10 to assume a vented state. For this reason, the amount of air moving in and out of the lamp when the latter is lighted and unlighted is the maximum after a fixed period of time, and thereafter gradually reduces. That is, the flow of air continues for a long period of time.

Accordingly, when the lamp is being lit, the water content released from the drying agent 8 is discharged outside over a long period of time, and the remaining water content is not left within the container 4. On the other hand, when the light is unlighted, the flowing-in open air contacts with the low-temperature drying agent 8 for a long period of time, and dehumidifying thereof is satisfactorily carried out.

In the prior art, the flowing-in and flowing-out quantity of air immediately after lighting and unlighting is large and thereafter rapidly reduces. As the result, the recycle action exerts a bad influence (i.e., is not satisfactorily carried out).

While in the above-described embodiment of FIG. 5, the threaded hole 4'*a* is provided in the end of the container 4, and the screw 9 is screwed therein from outside of the container 4, it is to be noted that the screw 9 can be screwed in from the inside of container 4. It is to be further noted that a through-hole in the end of the container 4 need not be formed into a threaded hole, but a nut can be used on the screw 9 to form an integral configuration.

As described above, according to the present invention, a permeable porous resin film (layer) is provided in the end of the container encasing therein the drying agent on the internal side of the housing, or a screw is inserted into a small hole in the inner end thereof, to form an extremely elongated vent passage to make the outflow convenient with respect to dehumidification. A sufficient dehumidifying effect may be expected, and the humidity test in accordance with FMVSS with a vent hole may be cleared. In addition, a headlamp with a vent hole has a smaller rise of internal pressure as compared with the totally closed type headlamp. Therefore, the pressure resistance requirement of parts constituting a lamp is relieved to considerably enhance reliability, reduce cost, reduce weight, and increase freedom of design. A further advantage is that the construction of the vent hole is simple, the number of parts is small, and the shape is compact.

What is claimed is:

1. A vehicle headlamp comprising:

a lamp housing; and an elongated container arranged at least partially within said housing, said container having front and rear ends, at least one small opening in eahc of said front and rear ends thereof, and an interior space between said small openings in said front and rear ends and in communication with said small openings in said front and rear ends, at least one small opening of said front end of said container being internal of said lamp housing and communicating with the interior of said lamp housing, said at least one rear end opening communicating with the outside of said lamp housing, and said container having a drying agent therein;

the size of said at least one small front end opening being smaller than that of said at least one small rear end opening.

2. The vehicle headlamp of claim 1, wherein said container further comprises a permeable porous resin film therein, said film being disposed between said at least one small front end opening and said drying agent.

3. The vehicle headlamp of claim 1, wherein said at least one small opening in said front end of said container comprises a small hole located internally of said housing, and a screw inserted into said small hole.

4. The vehicle headlamp of claim 3, wherein said screw has a thread groove thereon, the thread groove of said screw at least partly defining a vent passage from the interior of said container to the interior of said housing.

5. The vehicle headlamp of claim 3, wherein said at least one small hole in said front end of said container is screw threaded, and wherein said screw has threads which are thread-engaged with the screw threads of said threaded small hole, the thread grooves of the threads of said screw and threaded hole cooperatively forming a vent passage from the interior of said container to the interior of said lamp housing.

6. The vehicle headlamp of claim 5, wherein said screw has a head, and further comprising a split spring washer interposed between said head spring washer providing a vent passage.

7. The vehicle headlamp of claim 1, wherein said lamp housing comprises a rear reflector, and wherein said tubular container extends through said reflector.

8. The vehicle headlamp of claim 1, wherein said tubular container extends through a wall of said lamp housing.

9. The vehicle headlamp of claim 1, wherein said tubular container is arranged so that a substantial portion thereof is internal of said lamp housing, and is located at a place within said lamp housing where a change in temperature is rapidly produced when the lamp is turned on and turned off.

10. The vehicle headlamp of claim 1, wherein a substantial portion of said tubular container is arranged internally of said housing.

11. The vehicle headlamp of claim 10, further comprising duct means coupled to the rear end of said container which is external of said lamp housing, said duct means being in communication with said rear end opening of said housing.

12. The vehicle headlamp of claim 1, wherein said tubular container is integrally formed with said lamp housing.

13. The vehicle headlamp of claim 12, wherein said container further comprises a permeable porous resin film therein, said film being disposed between at least said small front end opening and said drying agent.

14. The vehicle headlamp of claim 13, wherein said container further comprises a filter disposed within said container at the rear end thereof, said filter having a higher permeability than said porous resin film and being disposed between said small rear end opening and said drying agent.

15. The vehicle headlamp of claim 1, wherein said container further comprises a filter disposed within said container at the rear end thereof, said filter being disposed between said small rear end opening and said drying agent.

16. The vehicle headlamp of claim 1, wherein said container further comprises a permeable porous resin film therein, said film being disposed between at least said small front end opening and said drying agent.

17. The vehicle headlamp of claim 1, wherein said rear end of said container is external of said housing.

18. The vehicle headlamp of claim 17, wherein said tubular container is integrally formed with said lamp housing.

19. The vehicle headlamp of claim 1, wherein said elongated container is generally tubular in shape.

20. The vehicle headlamp of claim 19, wherein said tubular container extends at least partially through a rear portion of said housing.

* * * * *

UNITED STATES PATENT AND TRADEMARK OFFICE

CERTIFICATE OF CORRECTION

PATENT NO. : 4,809,144

DATED : February 28, 1989

INVENTOR(S) : T. Suzuki

It is certified that error appears in the above-identified patent and that said Letters Patent is hereby corrected as shown below:

Column 2, line 34, "2a" should read --2 a--.

Column 2, line 35, "4a container" should read --4 a container--.

Column 4, line 60 (claim 1), "eahc" should read --each--.

Signed and Sealed this

Twenty-seventh Day of March, 1990

*Attest:*

JEFFREY M. SAMUELS

*Attesting Officer*

*Acting Commissioner of Patents and Trademarks*